US008201284B2

(12) United States Patent
Pokorski

(10) Patent No.: US 8,201,284 B2
(45) Date of Patent: Jun. 19, 2012

(54) PORTABLE TOILET

(76) Inventor: Daniel G. Pokorski, Romcoville, IL (US)

( * ) Notice: Subject to any disclaimer, the term of this patent is extended or adjusted under 35 U.S.C. 154(b) by 405 days.

(21) Appl. No.: 12/422,170

(22) Filed: Apr. 10, 2009

(65) Prior Publication Data

US 2009/0255044 A1 Oct. 15, 2009

Related U.S. Application Data

(60) Provisional application No. 61/044,753, filed on Apr. 14, 2008.

(51) Int. Cl.
*A47K 11/04* (2006.01)

(52) U.S. Cl. ..... 4/483; 4/484; 4/479; 4/451

(58) Field of Classification Search ..... 4/483, 484, 4/479, 451; 248/188.5; 224/521, 510; 403/109.1, 403/378–379.2; 297/344.12, 344.18
See application file for complete search history.

(56) References Cited

U.S. PATENT DOCUMENTS

| | | | | |
|---|---|---|---|---|
| 1,663,966 | A * | 3/1928 | Ament et al. | 4/484 |
| 2,675,256 | A * | 4/1954 | Cornell | 403/379.2 |
| 2,711,787 | A * | 6/1955 | Hallowell, Jr. et al. | 297/451.1 |
| 3,452,368 | A * | 7/1969 | Couper | 4/484 |
| 5,088,134 | A * | 2/1992 | Douglas | 4/484 |
| 6,385,790 | B1 * | 5/2002 | Abraham et al. | 4/484 |
| 6,443,406 | B1 * | 9/2002 | Frank | 248/125.8 |
| 7,066,676 | B2 * | 6/2006 | Tsai | 403/109.3 |

FOREIGN PATENT DOCUMENTS

| | | | |
|---|---|---|---|
| DE | 20315080 U1 | * | 1/2004 |
| DE | 202004005630 U1 | * | 9/2004 |
| FR | 1493686 | * | 9/1967 |
| FR | 1493686 A | * | 9/1967 |
| WO | WO 2005023071 A1 | * | 3/2005 |

* cited by examiner

*Primary Examiner* — Jason J Boeckmann
*Assistant Examiner* — Joel Zhou
(74) *Attorney, Agent, or Firm* — Erickson Law Group, PC

(57) ABSTRACT

A collapsible portable toilet having an expanded and a compressed state. The toilet has a seat and a base. The seat is connected to a top of a collapsible assembly and the base is connected to the bottom of the collapsible assembly. The toilet has a cover that is cylindrical and surrounds the collapsible assembly. The cover contains a coil that is resilient to the expended position. The cover has a plurality of fasteners for holding the toilet in a compressed state. In the expanded state a plurality of segments extend toward the ground or supporting surface. The stop arm is insertable into the collapsible assembly to secure the toilet in an expanded state. The toilet utilizes a disposable inner bag for use in the interior of the toilet. The toilet is fittable within a carrying bag when in a compressed state.

15 Claims, 12 Drawing Sheets

PORTABLE TOILET

This application claims the benefit of U.S. Provisional Patent Application No. 61/044,753 filed Apr. 14, 2008.

FIELD OF THE INVENTION

The invention relates to portable toilets for use by children.

BACKGROUND OF THE INVENTION

At a certain point a parent or other interested person desire to toilet train a child. However, situations arise where there are no suitable toilets for a young child. Children may be toilet training anywhere from the age of fifteen months old to an age of two years old or older. Some children with difficulty in training have developed a fear with certain uncomfortable experiences related to toilets.

The present inventor has recognized that it would be desirable to have a convenient, sanitary, comfortable, portable, and proportionate toilet for a toddler or small child to use, which is familiar in the home setting as well as a non-home setting. A non-home setting may include restaurants, shopping malls, nature settings, and travel settings. Further, the present inventor recognizes the need for a compact and lightweight toilet that requires minimal user effort for setup and close. Also, the present inventor has recognized that it would be desirable for a portable toilet to have a comfortable seat and back. The present inventor has recognized it would be desirable for a toilet to be stored in a compact state when not in use and carriable in a lightweight bag.

SUMMARY OF THE INVENTION

The invention provides a portable toilet that has an expanded and a compressed state. The toilet has a seat and a base. The seat is connected to the top and the base is connected to the bottom of a collapsible assembly. The collapsible assembly has a corresponding compressed state and an expanded state. The toilet has a cover that is cylindrical and surrounds the collapsible assembly. The cover contains a coil that is resiliently urged to an expanded position.

The cover has a plurality of fasteners for holding the toilet in a compressed state. When the fasteners are released, the force of the coil moves the toilet to an expanded state. The force of the coil presses against the ground or a supporting surface causing the seat to rise. Gravity causes the collapsible assembly to assume an expanded state by allowing a plurality of hollow segments of the collapsible assembly to descend. A stop arm is insertable into the collapsible assembly to secure the toilet in the expanded state. The toilet utilizes disposable inner bags. After use, the user removes and disposes of the disposable bag, removes the support arm from the collapsible assembly, compresses the toilet, and fastens the toilet in a compressed state with the fasteners. The toilet is placeable in a carrying bag when in a compressed state.

Numerous other advantages and features of the present invention will become readily apparent from the following detailed description of the invention and the embodiments thereof, and from the accompanying drawings.

DETAILED DESCRIPTION

Figure 1:
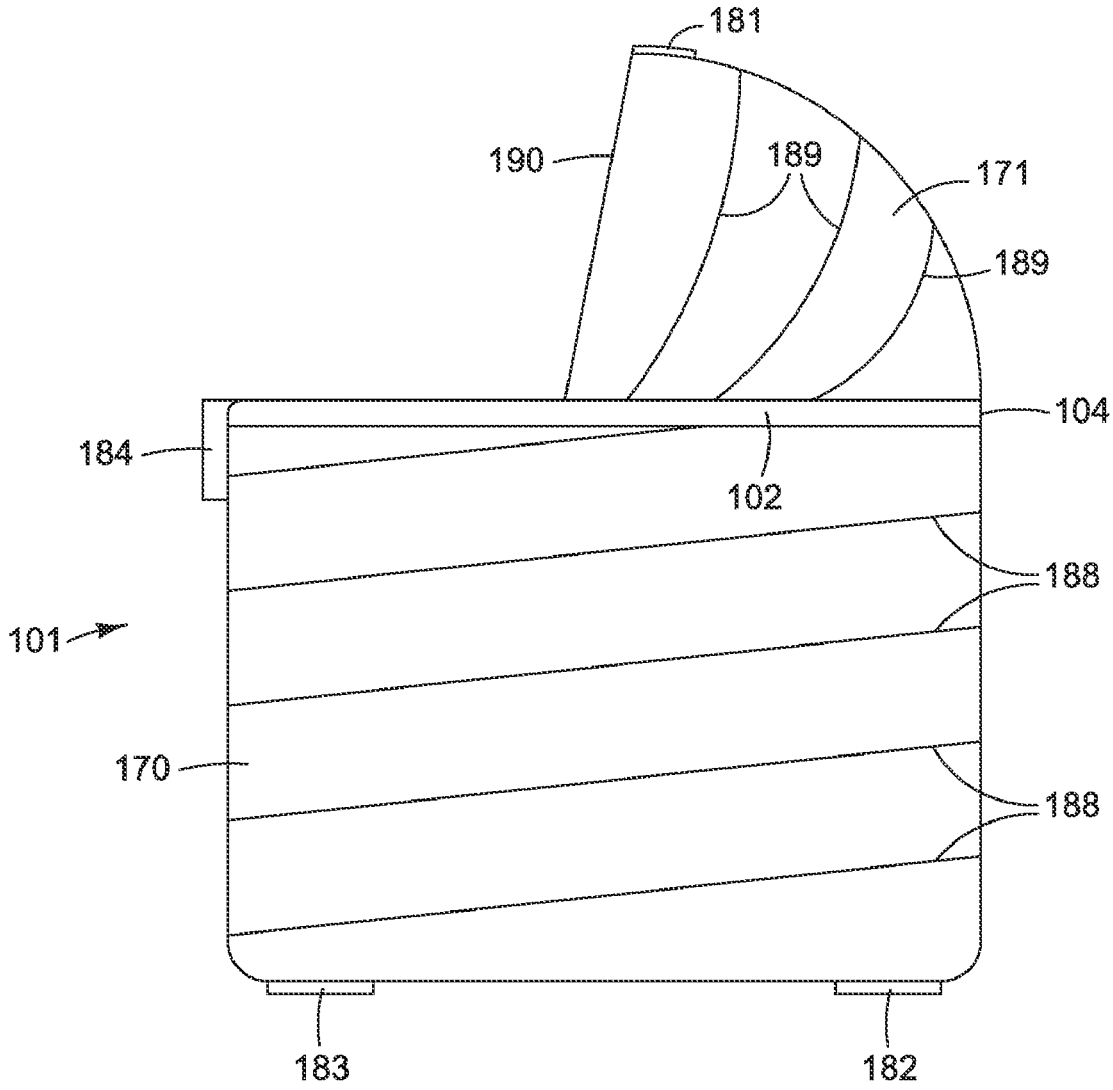
FIG. 1 is a side view of an embodiment of the portable toilet in an expanded state.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
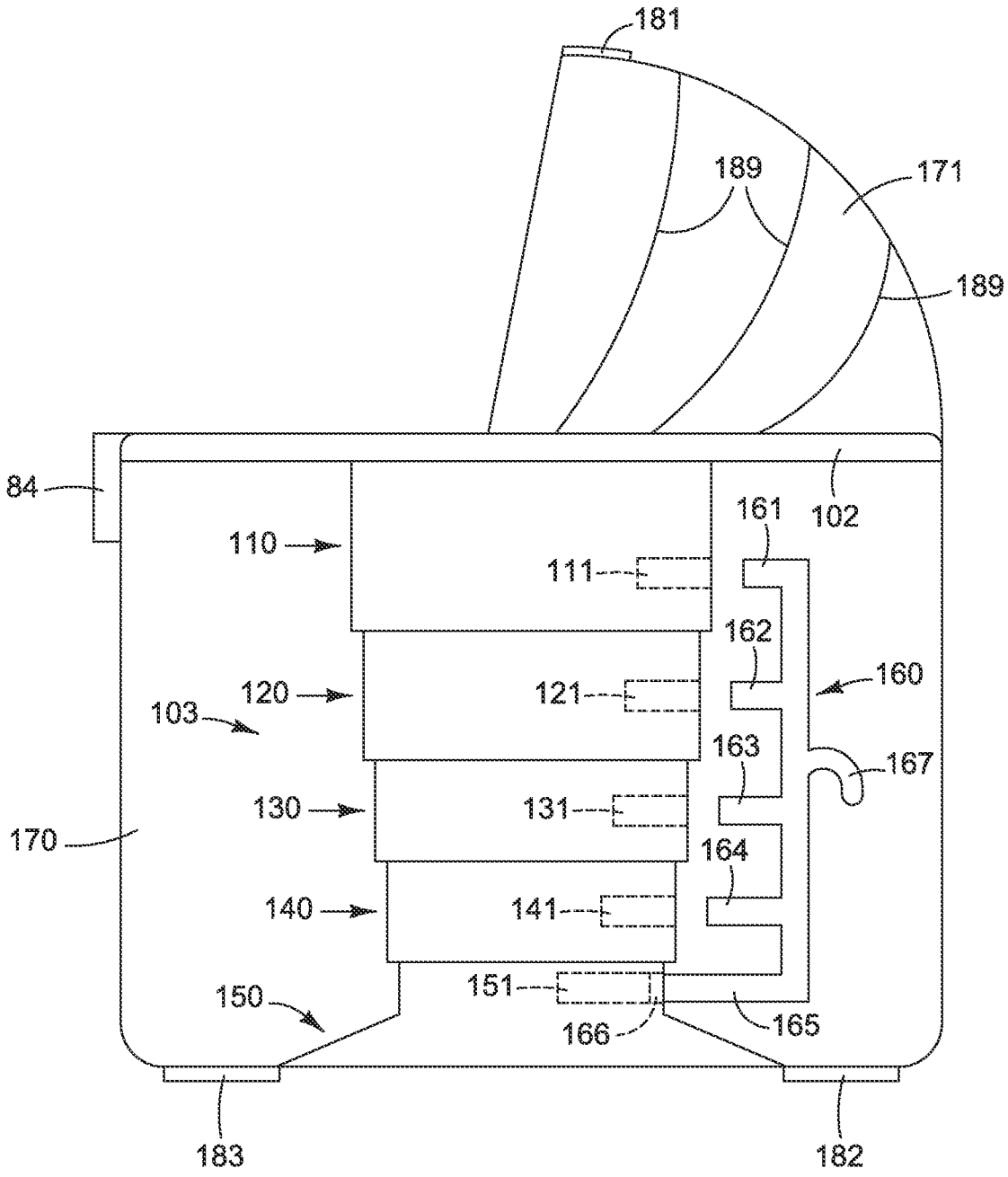
FIG. 2 is a side view of the portable toilet with the cover partially removed making the collapsible assembly visible.

FIG. 1 shows a side view of an embodiment of the portable toilet. FIG. 2 shows the toilet with the cover 170 partially removed to expose the inner collapsible assembly 103. The collapsible assembly comprises a plurality of segments 120, 130, 140, a top 110 and a base 150. The segments may be hollow and may be made out of any sturdy material, such as hard plastic, or lightweight hard plastic. The seat 102 is connected to the top 110. The seat comprises a hole 108. The base 150 sits on an exterior surface, such as the ground. Each segment has a hole 121, 131, 141. The base also has a hole 151 and the top has a hole 111. The toilet also has a stop arm 160 with a plurality of inserts 161, 162, 163, 164, and 165 for inserting into the holes 111, 121, 131, 141, 151 when the toilet is in an expanded state to support the toilet in an expanded state.

Figure 3:
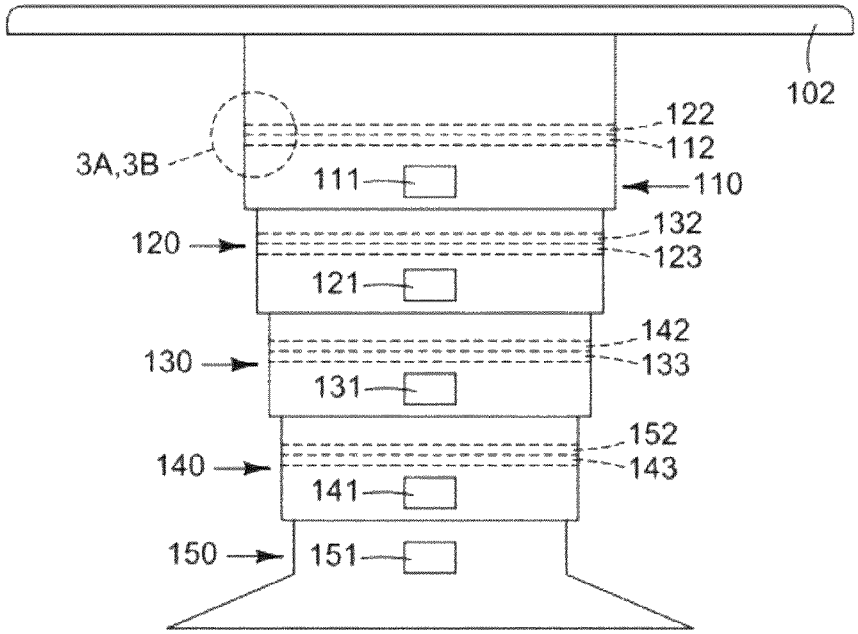
FIG. 3 is a front view of the portable toilet with the cover not shown.

FIG. 3 shows each segment 120, 130, 140, the top 110, and the base 150 are configured so that a second segment positioned below a first segment will fit within the first segment. As a result, the inner collapsible assembly 103 can be telescoped between a compressed state and an expanded state. In an embodiment, segment 120 fits within the top 110; segment 130 fits within segment 120; segment 140 fits within segment 130; and a portion of the base 150 fits within segment 140.

Figure 3A:
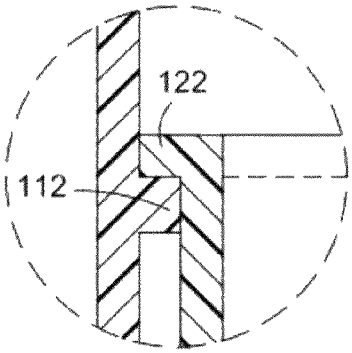
FIG. 3A is a detailed sectional view taken from FIG. 3 of the segment contact point.
Figure 3B:
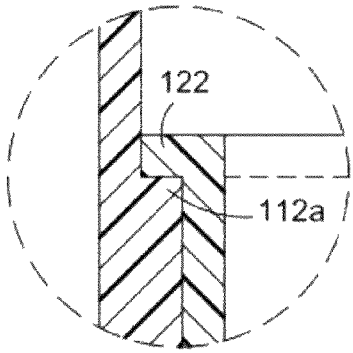
FIG. 3B is a detailed sectional view taken from FIG. 3 of an alternative embodiment of the segment contact point.
Figure 4:
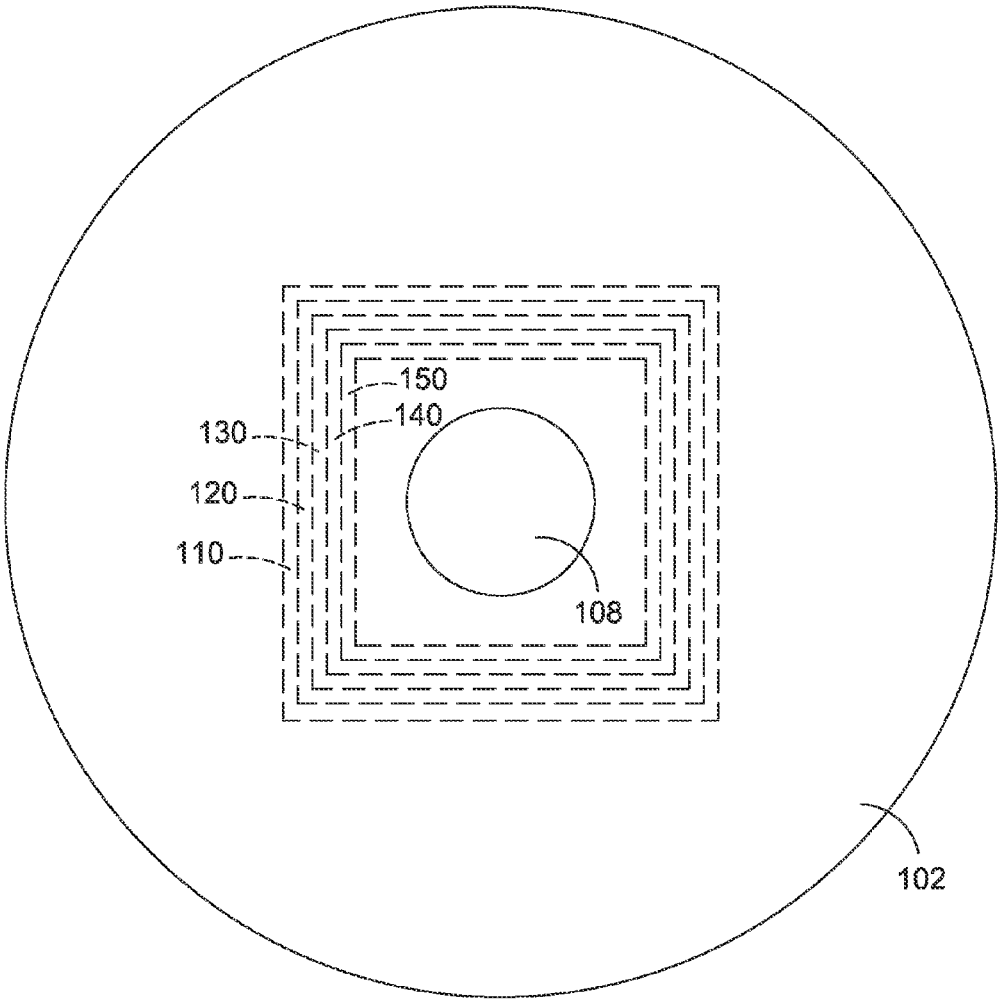
FIG. 4 is a top view of the portable toilet.

Each segment has an inner lip 123, 133, 143 and an outer lip 122, 132, 142. The top 110 has an inner lip 112. In one embodiment, the inner lip 112, 123, 133, 143 is located in an area of the segment between the top and bottom of the segment and encircles the segment in a horizontal plane. The outer lip of each segment is located at the top of the segment, encircling the entire perimeter. In place of an outer lip the top 110 is fixed to toilet seat 102. The base has an outer lip 152. When the collapsible assembly 103 is in an expanded state the inner lip of each segment contacts the outer lip of the lower segment and prevents the segments from separating from one another. For example, the inner lip 112 of segment 110 contacts the outer lip 122 of segment 120. Likewise, the inner lip 123 of segment 120 contacts the outer lip 133 of segment 130; the inner lip 133 of segment 130 contacts the outer lip 142 of segment 140; and the inner lip 143 of segment 140 contacts the outer lip 152 of the base 150. FIG. 3A provides a detailed view of the contact point between segments. The outer lip 122 of the segment 120 contacts the inner lip 112 of the segment 110. FIG. 3B provides a detailed view of an alternative embodiment. The outer lip 122 of the segment 120 contacts the inner ledge 112*a* of the segment 110. The detailed views in FIGS. 3A and 3B of the contact point shown between segments 110 and 120, also demonstrates the contact points between segment 120 and 130, segment 130 and 140, and segment 140 and the base 150. Referring to FIG. 1, the cover 170 comprises a coil 188 that is fixed in place in the interior of the cover 170. The cover 170 is connected to the seat 102. The cover 170 may comprise any flexible material, including for example vinyl or polyester. The cover 170 is cylindrical and surrounds the collapsible assembly 103. The cover 170 comprises a backing 171 that extends above the seat 102. The backing 171 is curved around a portion of the perimeter of the toilet seat 102. In one embodiment, the back 171 reaches its highest point relative to the seat 102 at the vertical plane intersecting the back point 104 of the seat. In one embodiment, the seat and the backing comprises of flexible comfortable material that conforms to the user child's body when used.

The coil 188 is fastened to the interior of the cover 170 so that the coil 188 moves with the cover 170. The fasteners connecting the cover 170 and the coil 188 may include, for example, thread, glue, or hook and loop fastening material (VELCRO). The coil has a flexible resiliency toward an expanded state. In an embodiment, the coil 188, 189, 190 may comprise metal, metal alloy, stainless steel, or any other material having a flexible property capable of compression and having a resiliency toward an expanded state. In an embodiment, the coil 188 of the cover 171 and the coil 189, 190 of the backing comprise a continuous coil where the top coil 190 of the backing is at a 50 degree angle relative to the horizontal plane occupied by the seat 102. Moreover, the angle of the coils 188 relative to the bottom of the cover 170 may be 20 degrees. However, one skilled in the art will recognize that the invention is not limited to the specific angles or measures provided.

Figure 5:
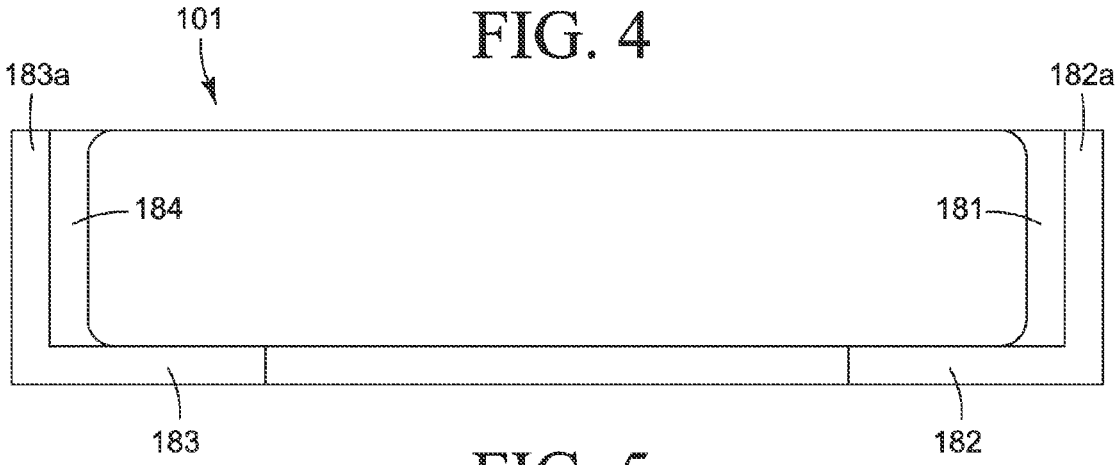
FIG. 5 is a side view of an embodiment of the portable toilet in a compressed state.

The cover has a plurality of fasteners 181, 182, 183, 184. FIG. 5 shows the toilet in a compressed state where the fastener 182 connects with a loose end 182*a* to fastener 181, and the fastener 183 connects with a loose end 183*a* to fastener 184 for holding the toilet 101 in a compressed state. When the fasteners 181, 184 are released from the other fasteners 182, 183 the force of the coil 188 within the cover moves the toilet 101 to an expanded state as shown in FIG. 1. The force of the coil 188 presses, for example, against the ground causing the seat 102 to rise. Gravity causes the collapsible assembly to assume an expanded state by allowing the segments to move toward the ground. The toilet 101 is in its compressed state, as shown in FIG. 5, when the fasteners 181, 184 are connected to the corresponding fasteners 182, 182.

Figure 5A:
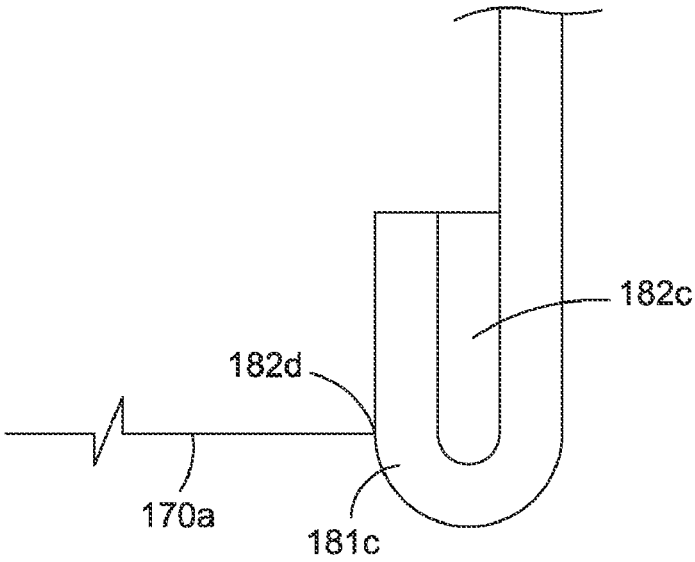
FIG. 5A a fragmentary section view of a toilet in a closed state similar to that shown in FIG. 5.

FIG. 5A shows an alternative embodiment where the fastener 181 of FIG. 1 corresponds to the faster of 181*c* and the fastener 182 of FIG. 1 corresponds to the fastener 182*c* of FIG. 5A. The receiving fastener 182 of FIG. 5A is on the interior wall of the cover 170. The fastener 181*c* connects to the fastener 182*c* through an opening 182*d* in the floor 170*a* of the cover.

After the toilet reaches an expanded state, the user then inserts the stop arm 160 into the holes 111, 121, 131, 141, 151. The user may access the stop arm 160 by lifting a portion of the cover. When the stop arm 160 is inserted, the stop arm supports the segments in the expanded position, at which point the toilet is structurally secure for use. The user attaches a disposable bag to the inner surface of the toilet. The toilet is now ready for use. Once the toilet has been used, the user removes and disposes of the disposable bag, removes the support arm 160 from the holes 111, 121, 131, 141, compresses the toilet, and fastens the toilet in a compressed state by engaging the fasteners 181, 184, 182, 183.

In one embodiment the support arm 160 has a stop 166 that prevents the arm 160 and insert 165 from being removed from the base 150. When the inserts 161, 162, 163, 164 are removed the insert 165 his held in place by the stop 166. The insert 165 is of sufficient length that the insert 165 remains in hole 151 while the other inserts 161, 162, 163, 164 are outside of their corresponding holes 111, 121, 131, 141.

The support arm is pivotable about the axis defined by the insert 165. Therefore, the user may rotate the arm 90 degrees to a horizontal position before putting the toilet into a compressed state. In an embodiment, when the arm is in a horizontal position, the insert 161 and insert 165 are in substantially the same horizontal plane and being substantially parallel to the seat. In one embodiment, when the arm is in a horizontal position, the arm fits within the cover 171 when the toilet is in a compressed state as well as in an expanded state.

Figure 6:
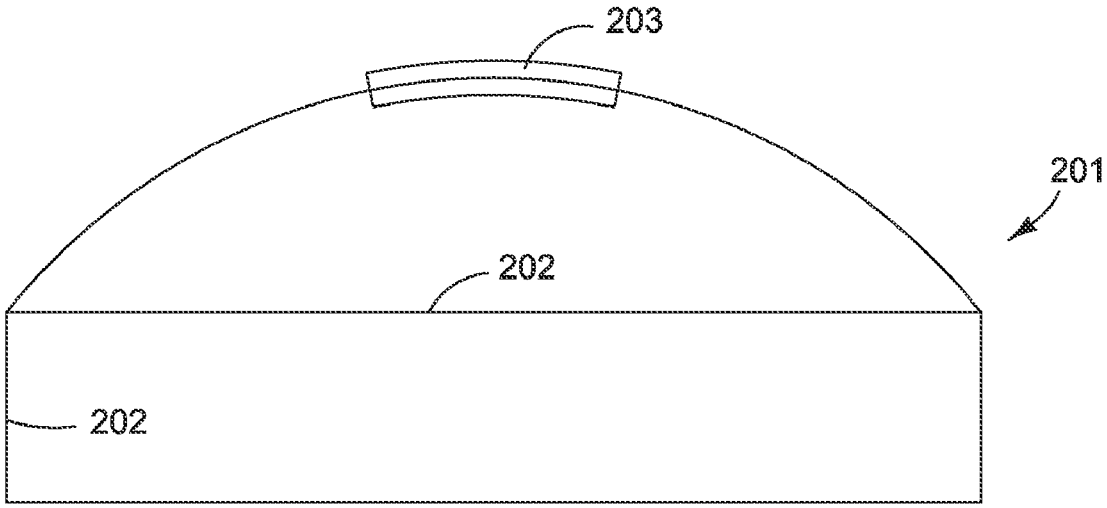
FIG. 6 is a side view of a portable toilet carrying bag.

When the toilet is in a compressed state it may be stowed in a carrying case as shown in FIG. 6. The case has fasteners 202, such as for example zippers, along one or more edges of the bag for enclosing the toilet within the bag.

Figure 7:
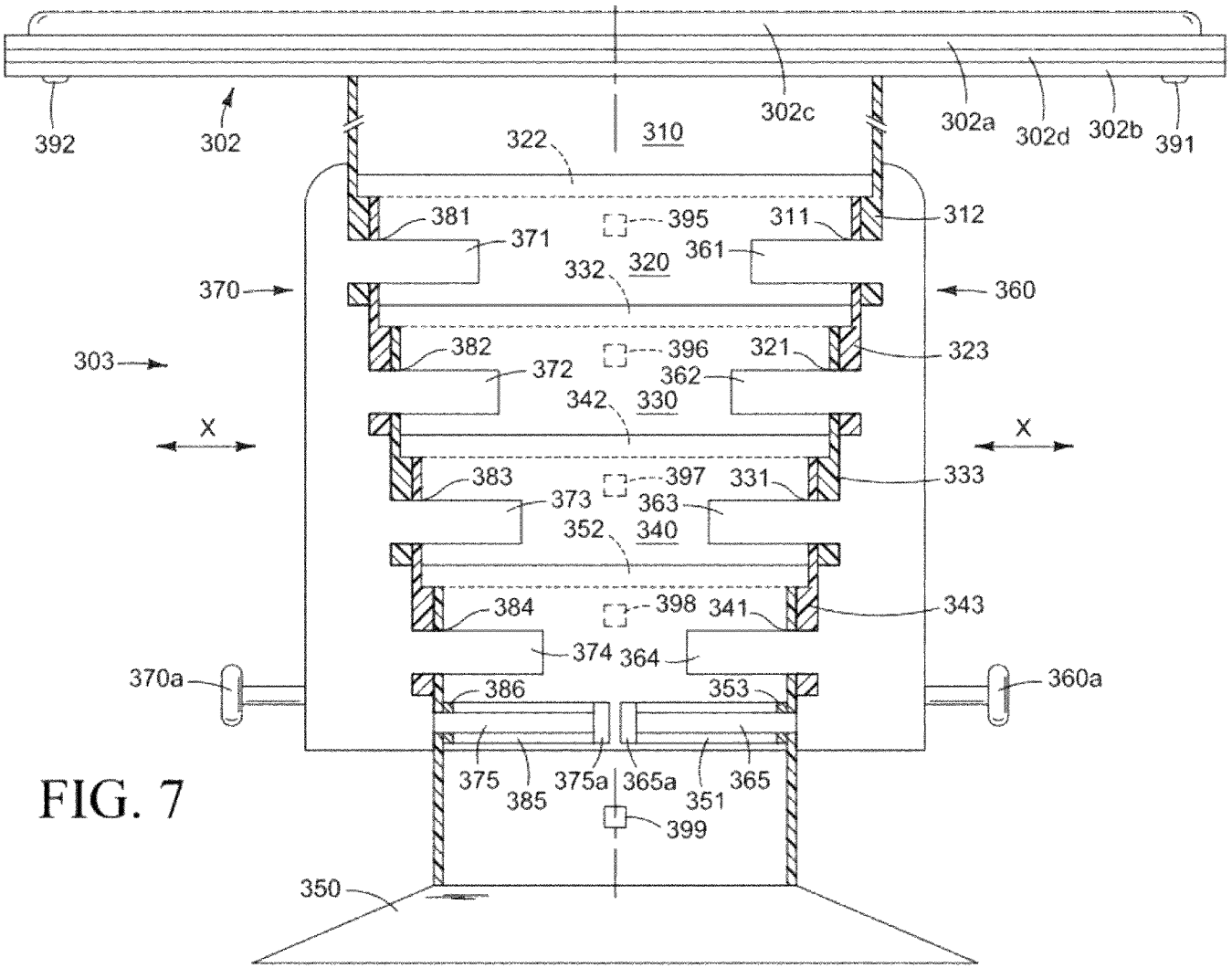
FIG. 7 is a front view of an alternative embodiment of a portable toilet with the cover not shown.

FIG. 7 shows an alternative embodiment, with the cover not shown, comprising two stop support arms 360 and 370. Each segment 320, 330, 340, the top segment 310, and the base 350 are configured so that a second segment positioned below a first segment will fit within the first segment. As a result, the inner collapsible assembly 303 can be telescoped between a compressed state and an expanded state. Segment 320 fits within the top segment 310; segment 330 fits within segment 320; segment 340 fits within segment 330; and a portion of the base 350 fits within segment 340.

In an alternative embodiment the segments of the collapsible assemble could also be configured so that the base 350 is the largest segment, the top is the smallest segment, and the intermediate segments are progressively smaller from the base to the top. In this alternative embodiment, segment 340 fits within base segment 350, segment 330 fits within segment 340, segment 320 fits within segment 330, segment 310 fits within 320.

Figure 8:
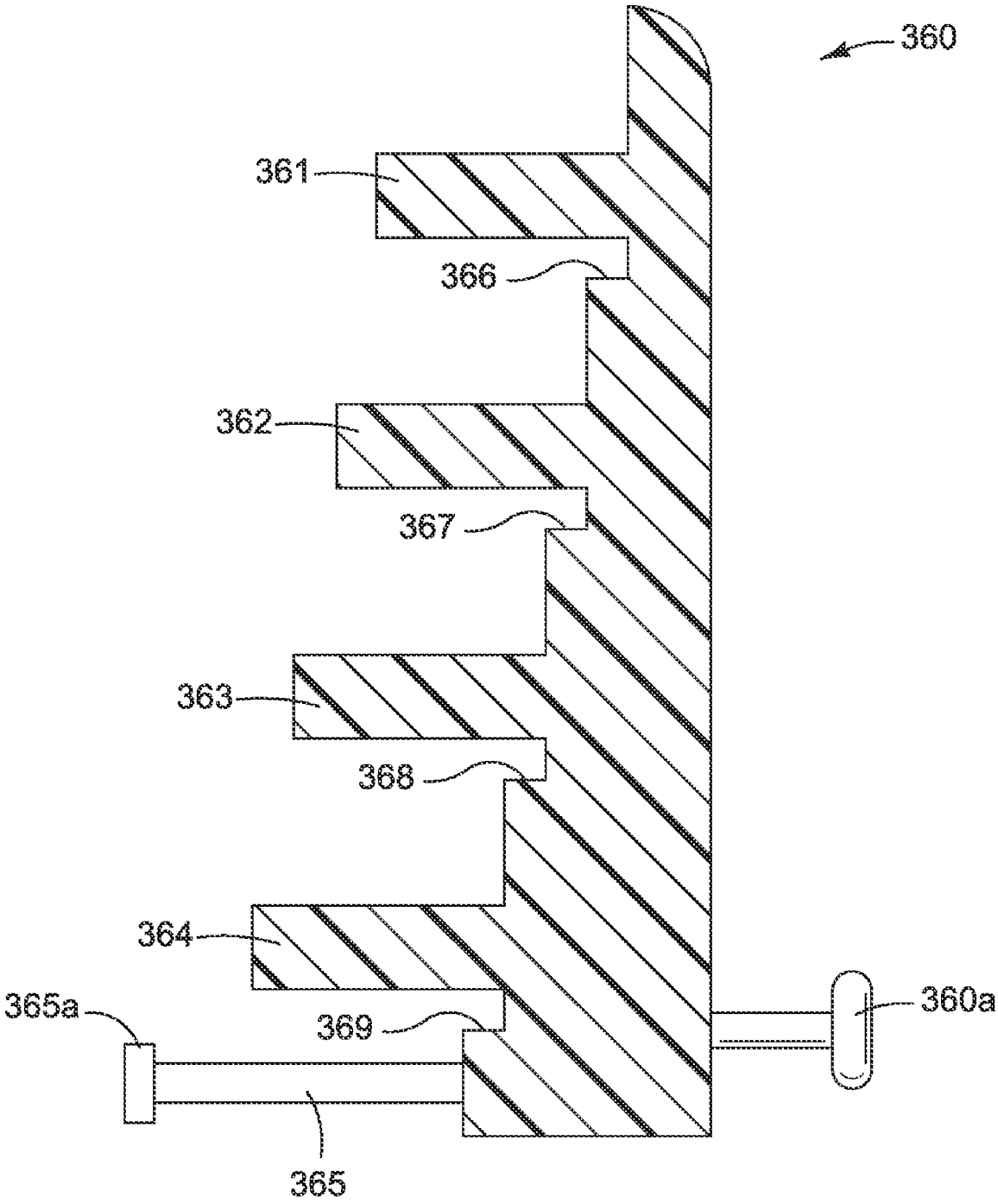
FIG. 8 is a sectional side view of a stop support arm.

The embodiment shown in FIG. 7 has a first stop arm 360 and a second stop arm 370 each being mirror image identical to the other, and therefore a description of arm 360 will explain the second arm 370. A detailed view of the arm 360 is shown in FIG. 8. The arm 360 has a plurality of inserts 361, 362, 363, 364, and 365 for inserting into the holes 311, 321, 331, 341, 351 when the toilet is in an expanded state to support the toilet in an expanded state. Correspondingly, arm 370 has a plurality of inserts 371, 372, 373, 374, and 375 for inserting into the holes 381, 381, 381, 381, 381 when the toilet is in an expanded state to support the toilet in the expanded state.

Figure 9:
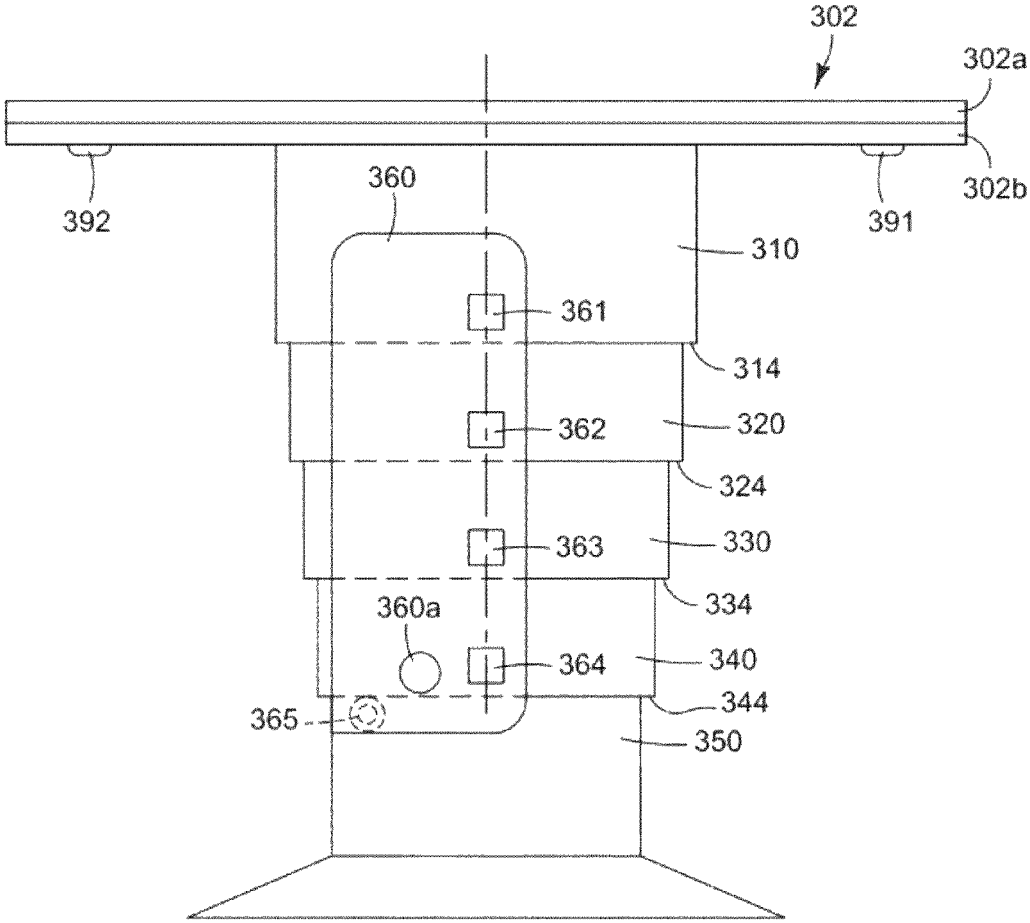
FIG. 9 is a side view of the alternative embodiment with the cover not shown.

In the alternative embodiment shown in FIG. 7, the arm 360 comprises a plurality of segment shelf supports 366, 367, 368, and 369. When the arm is in an engaged supporting position as shown in FIG. 7, the segment shelf supports 366, 367, 368, and 369 of the arm 360 support the segment bottoms 314, 324, 334, and 344 correspondingly. The segment bottoms 314, 324, 334, 344 are shown labeled in FIG. 9.

The arms move in the X direction of FIG. 7 to disengage the inserts 361, 362, 363, 364 from the holes 311, 321, 331, 341 and to disengage segment shelf supports 366, 367, 368, and 369 from the segment bottoms 314, 324, 334, 344. Each arm 360 and 370 comprise a handle 360*a* and 370*a* respectively for moving the arms 360 and 370 in the X direction, either toward or away from the segments 310, 320, 330, 340, 350. The retained pegs 365 and 375 of the arms 360 and 370 respectively are prevented from completely exiting the retaining holes 351 and 385 respectively by stops 353 and 386 respectively. The stops 353 and 386 prevent the peg heads 365*a* and 375*a* of the retained pegs 365 and 375 from exiting the retaining holes 351 and 385 respectively. When the segments are in the expanded state and the arms are in the engaged state, the arms support the segments in the expanded state.

Figure 10:
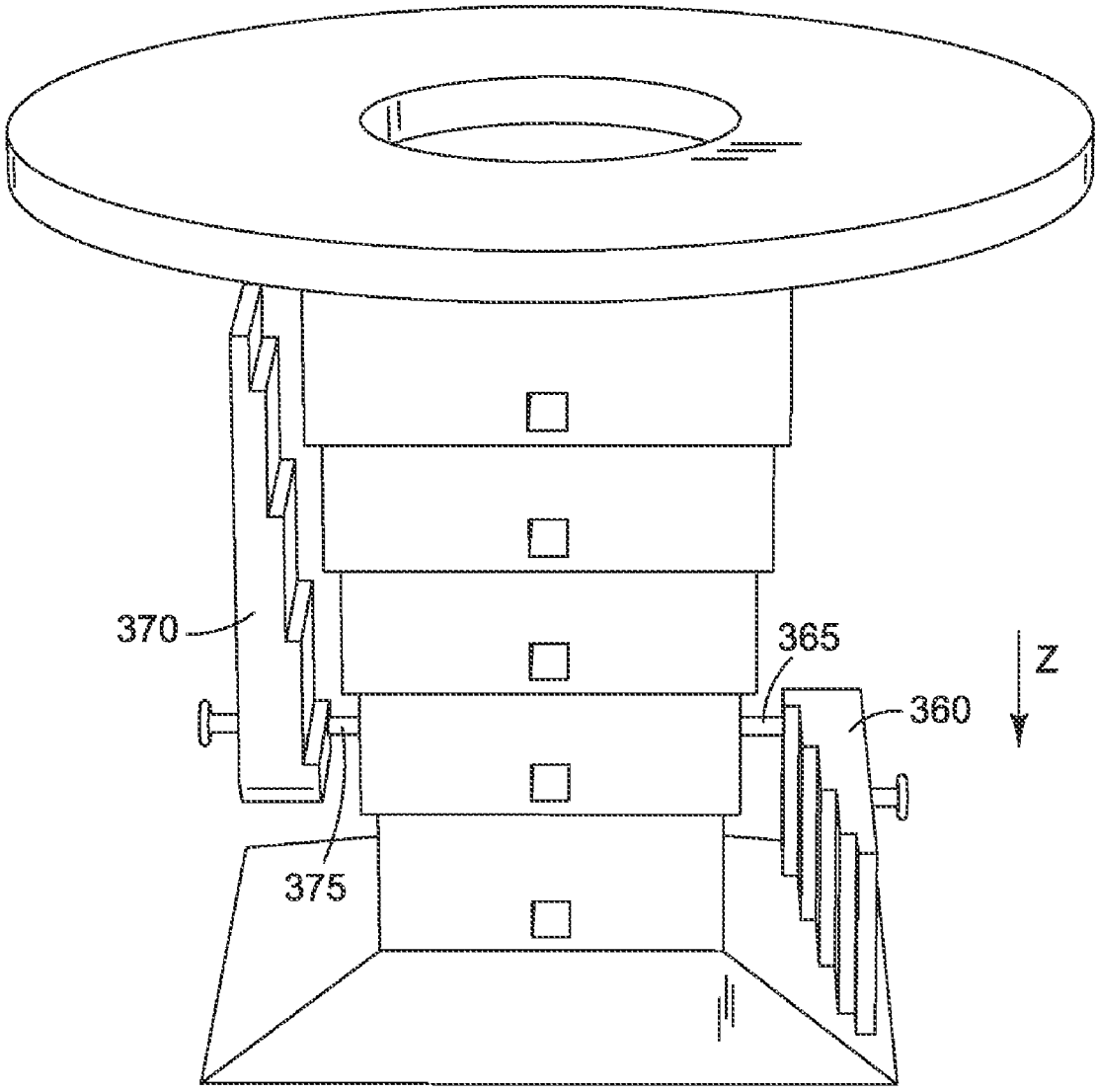
FIG. 10 is a perspective view of the alternative embodiment with the cover not shown and the inserts of the arms not shown.

Referring to FIG. 10, the arms are rotatable downward in the Z direction to the compact state as shown by arm 360 from the expanded state as shown by arm 370. The arms 360, 370 are rotatable either direction on a rotation axis about the retained pegs 365, 375, when the inserts are disengaged from the holes.

Like the embodiment shown in FIGS. 2 and 3, each of the segments of the embodiment shown in FIG. 7 has an inner ledge 323, 333, 343 and an outer lip 322, 332, 342. In one embodiment, the inner ledge and the outer lip extend continuously around the entire segment. The inner ledge 312, 323, 333, 343 is located in an area of the segment between the top and bottom of the segment and encircles the segment in a horizontal plane. The outer lip of each segment is located at the top of the segment, encircling the entire perimeter. In place of an outer lip the top 110 is fixed to toilet seat 302. The base has an outer lip 352. When the collapsible assembly 303 is in an expanded state the inner ledge of each segment contacts the outer lip of the lower segment and prevents the segments from separating from one another. For example, the inner ledge 312 of segment 310 contacts the outer lip 322 of segment 320. Likewise, the inner ledge 323 of segment 320 contacts the outer lip 333 of segment 330; the inner ledge 333 of segment 330 contacts the outer lip 342 of segment 340; and the inner ledge 343 of segment 340 contacts the outer lip 352 of the base 350. The inner ledge and the outer lip may be configured as shown in FIG. 3A or 3B. The base 350 sits on an exterior surface, such as the ground.

Figure 13:
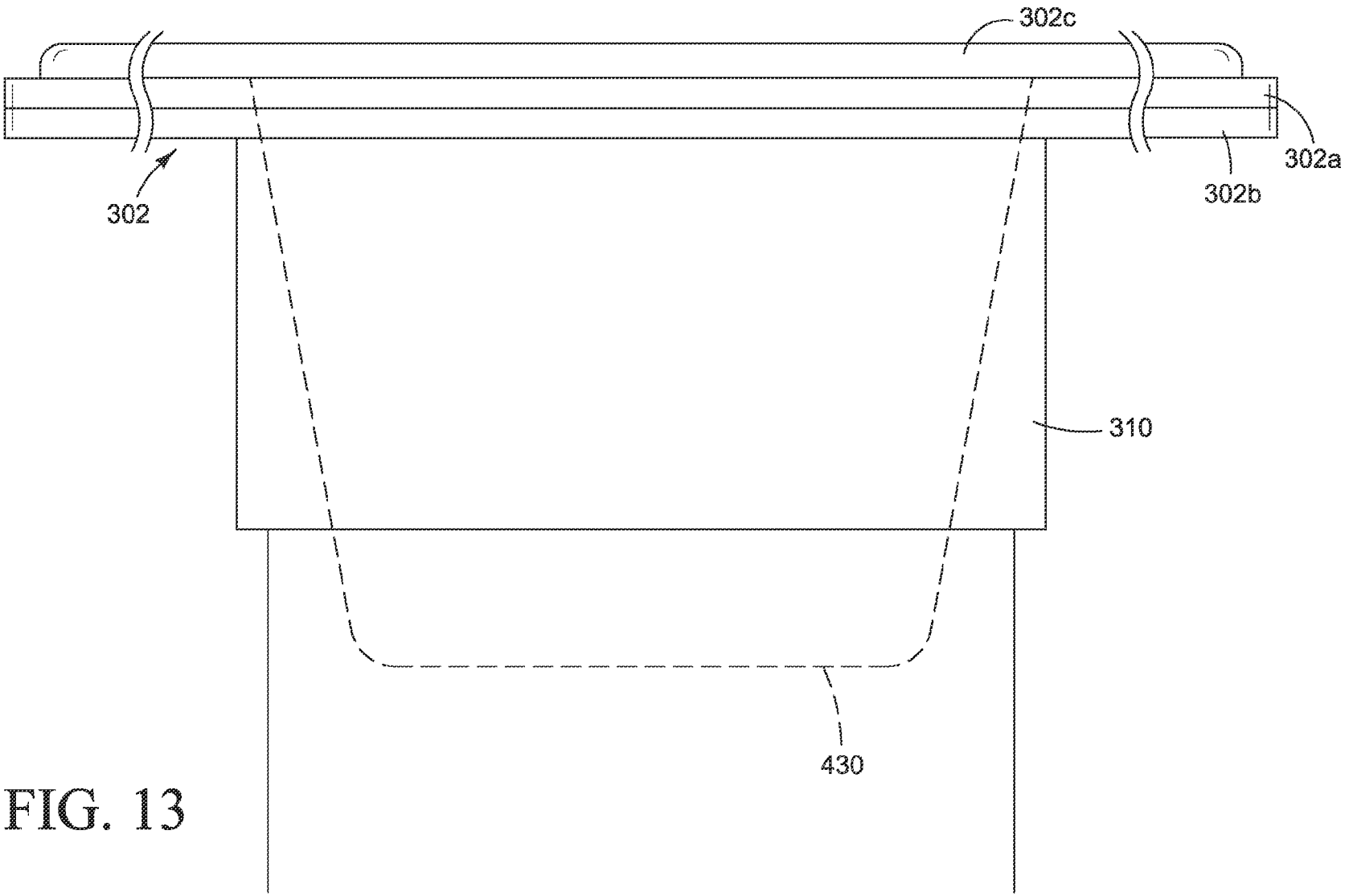
FIG. 13 is a fragmentary schematical view of an upper portion of the alternative embodiment.

The seat 302 is connected to the top segment 310. In an embodiment, as shown in FIG. 7, the seat comprises an upper rim 302*a* and a lower rim 302*b* connected with one or more fasteners 391, 392, which may comprise bolts or stainless steel bolts, The fasteners 391, 392 may comprise end caps to cover the treads extending below the seat 302. A middle seat 302*d* may be secured between the upper rim 302*a* and the lower rim 302*b*. Additional fasteners may be provided about the seat, for example in a circular pattern, to secure the upper rim 302*a* and the lower rim 302*b* together. The upper and lower seats may be connected by other known fastening means such as an adhesive. The lower rim 302*b* may comprise part of, or be molded with the top segment 130. The rim 302*a*, 203*b* may extend from the edge of the seat to the hole 108 opening, or it may cover a lesser area revealing the middle seat 302*d*. The seat 302 may also comprise a seat cushion 302*c*. As shown in FIG. 13, a waste catching device 430, such as a plastic bag, may be secured between the cushion 302*c* and the upper seat 302*a* and extend down. The waste catching device 403 is arranged beneath the hole 108 and extends into the hollow area of the collapsible assembly 103, 303. In an embodiment, the cushion 302*c* maybe be a disposable cushion with a waste catching device attached to the cushion 302*c*.

Figure 11:
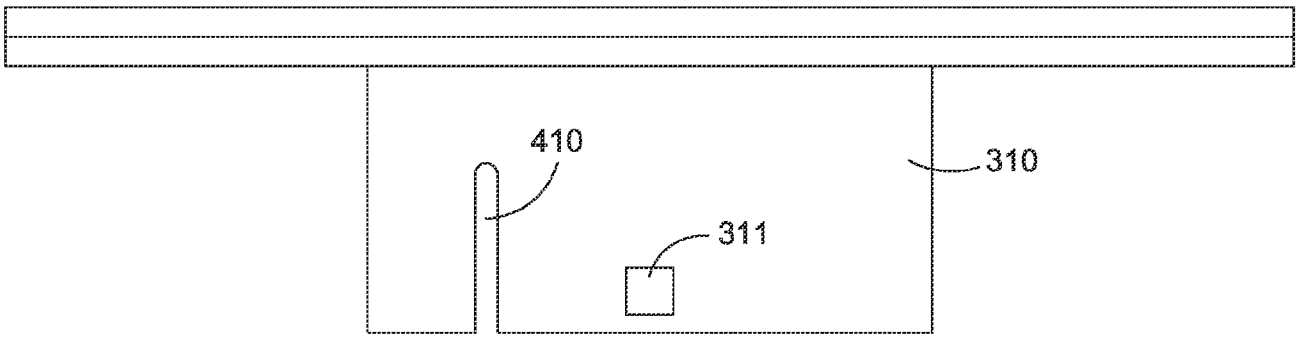
FIG. 11 is a side view of a top segment of the alternative embodiment.
Figure 12:
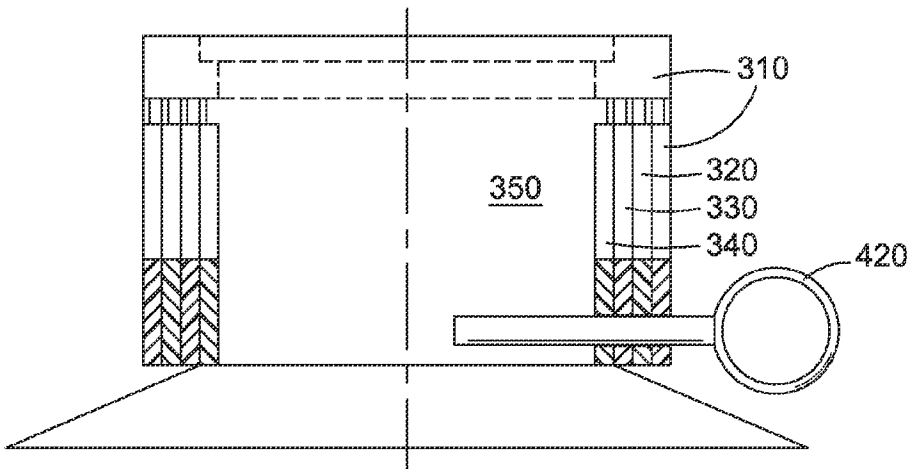
FIG. 12 is a side view of the collapsible assembly of the alternative embodiment.

Referring to FIG. 11, each segment contains a first slot 410 on one side of the segment and a second slot (not shown) on the opposite side of the segment. The slots provided in each segment allow a portion of the retained pegs 365 and 375 to pass through the slots to allow the segments and the toilet 101 to fully compress as shown in FIG. 12. While FIG. 11 shows a slot in segment 310, slots are provided in each segment except for the bottom segment 350, 150. The slots of each segment of the inner collapsible assembly 103, 303 are aligned vertically.

FIG. 12 shows the inner collapsible assembly 303 in a collapsed state. In the collapsed state the lock holes 396, 397, 398, and 399 align and the locking pin 420 is placeable in the aligned lock holes to secure the toilet in the collapsed position. The top segment 310 covers at least a portion of other segments when the toilet is in a collapsed position.

The toilet can be opened to an expanded state by an opening procedure. First the toilet is turned upside down exposing the bottom and the base 150, 350. The locking pin 420 is removed from the lock holes 396, 397, 398, and 399. The base 170*a* is held and the fasteners released. The unrestrained coil 188, 189, 190 will expand allowing gravity to extend the segments to move the inner collapsible assembly to its expanded state. The first and second arms 360, 370 are rotated to a position in line with the support holes 311, 321, 331, 341, 351 and 381, 381, 381, 381, 381. The inserts of each arm 360, 370 are pushed into said holes to secure the inner collapsible assembly in the expanded position. The toilet is placed on a surface for usage.

Figure 14:
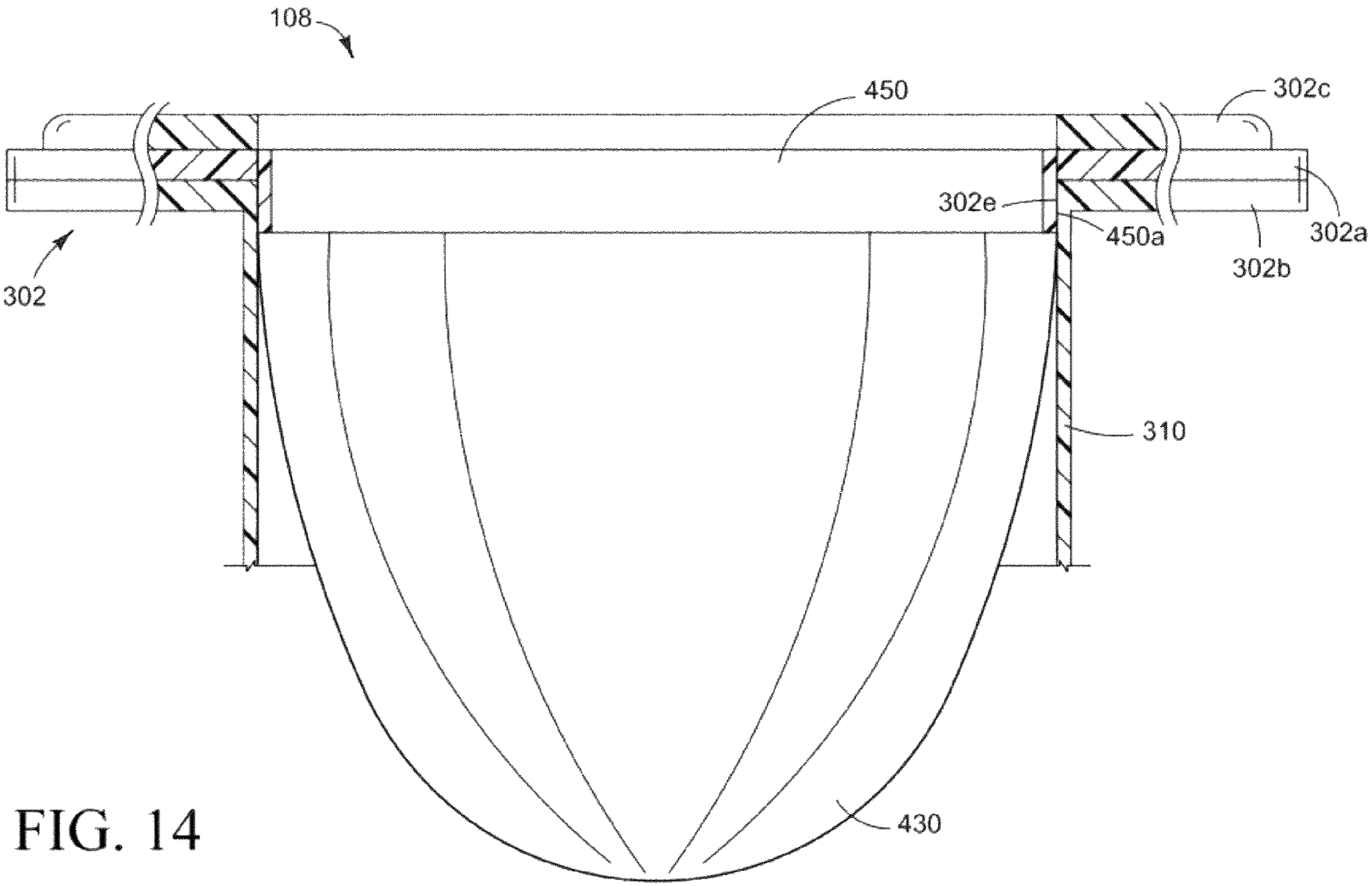
FIG. 14 a sectional view of a portion of the toilet.

The toilet can be closed to a collapsed position by a closing procedure. First, any waste is removed from the toilet by the waste catching device 430. The inner collapsible assembly is accessed by raising the cover or turning the toilet on its side. The arms are disengaged from the segments. The toilet is rotated upside down. The assembly is pushed downward until the toilet is in the collapsed position. The locking pin 420 is inserted into the lock holes 396, 397, 398, and 199. The fasteners are secured together. FIG. 14 shows a sectional view of a portion of the toilet. An insert 450 may be removably placed in the opening 108 and friction fitted on the edge 302*e* of the opening 108 where the upper rim 302*a* and a lower rim 302*b* of the seat 302 define the edge 302*e* of the opening. The outer edge 450*a* of the insert 450 is friction fitted against the edge 302*e* of the opening 108. The edge 302*e* of the opening 108 surrounds the cylindrical insert 450. A waste catching device 430, such as a plastic bag may be secured in between the outer edge 302*e* of the opening 108 and the outer edge 450*a* of the insert 450 so as to extend into the hollow area of the collapsible assemble below the opening 108.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A portable toilet comprising:

a seat and a base segment;

a collapsible assembly operatively connected to the seat and the collapsible assembly comprising a plurality of segments located between the seat and the base segment, the collapsible assembly having a compressed state and an expanded state;

the collapsible assembly having the base segment at the bottom of the collapsible assembly;

at least one support arm for securing the collapsible assembly in the expanded state, said support arm having at least two vertically spaced apart inserts, the at least two vertically spaced apart inserts are configured to releaseably engage with at least two segments of said plurality of segments of the collapsible assembly, each of said at least two segments comprise a support hole configured to receive one of said inserts to support the collapsible assembly in the expanded state; and, the at least one support arm having a retained peg;

the base segment having a retaining hole receiving the retained peg;

the retaining hole having a stop to retain the retained peg within the retaining hole;

the retained peg movable within the retaining hole to allow the at least one support arm to move from an engaged support position where the arm supports the toilet in the expanded state to a disengaged position.

2. The toilet of claim 1, comprising a cover attached to the seat and at least partially surrounding the collapsible assembly; the cover comprising a coil resiliently biased towards expanding the cover.

3. The toilet of claim 1, wherein each smaller segment of the plurality of segments fitable within a progressively larger segment of the plurality of segments;

a portion of said base segment fitable within the smallest of the plurality of segments.

4. The portable toilet of claim 3, wherein said each segment of the plurality of segments comprises an outer lip and an inner lip;

the outer lip of each segment engages the inner lip of the next progressively larger segment when the collapsible assembly is in the expanded state.

5. The toilet of claim 1, wherein each segment of the plurality of segments has a segment bottom; and wherein the at least one support arm further comprises at least one segment support shelf configured to engage with one of said segment bottoms to support the collapsible assembly in the expanded state.

6. The toilet of claim 5, wherein each segment of said plurality of segments comprises a support hole; the at least two vertically spaced apart inserts comprises a plurality of inserts that correspond in number to the plurality of segments; each of the inserts removeably engages with one of the support holes of the plurality of segments to support plurality of segments the collapsible assembly in the expanded state.

7. The toilet of claim 1, wherein the at least one support arm comprises two support arms configured to engage opposite sides of the collapsible assembly to support the collapsible assembly in the expanded state.

8. A portable toilet comprising:

a seat and a base;

a collapsible mechanism operatively connecting the seat and the base, and said collapsible mechanism having a compressed state and an expanded state; said collapsible mechanism comprising the base and a plurality of segments;

at least two support mechanisms configured to secure the collapsible mechanism in the expanded state, said at least two support mechanisms each comprising at least two vertically spaced apart inserts;

the at least two vertically spaced apart inserts of each support mechanism are vertically aligned and engage with at least two segments of said plurality of segments of the collapsible mechanism;

each of said at least two segments comprise a support hole configured to receive one of the two vertically spaced apart inserts to support the collapsible mechanism in the expanded state; and each support mechanism having a retaining peg;

the collapsible assembly having a retaining hole receiving the retaining peg;

the retaining hole having a stop to prevent the retaining peg from being completely removed from the retaining hole;

the retaining peg moveable within the retaining hole to allow the each support mechanism to move from an engaged support position where the arm supports the toilet in the expanded state to a disengaged position.

9. The toilet of claim 8, wherein each smaller segment of the plurality of segments is fitable within a progressively larger segment of the plurality of segments; a portion of said base segment fitable within the smallest of said segments.

10. The toilet of claim 8, wherein each segment of the plurality of segments has a segment bottom; and wherein the at least two support mechanisms each further comprise at least one segment horizontal support shelf configured to engage with the segment bottom of at least one segment of the collapsible mechanism to support the collapsible mechanism in the expanded state.

11. The toilet of claim 9, wherein said each segment of the plurality of segments comprises an outer lip and an inner lip; the outer lip of said each segment is adjacent the inner lip of the progressively larger segment when the collapsible assembly is in the expanded state.

12. The toilet of claim 8, wherein each segment of said plurality of segments comprises a support hole; the at least two vertically spaced apart inserts comprises a plurality of inserts that correspond in number to the plurality of segments; each of the inserts removeably engages with one of the support holes of the plurality of segments to support the plurality of segments of the collapsible assembly in the expanded state; and wherein each segment has a segment bottom; and wherein each support mechanism comprises a plurality of segment bottom support shelves, each of the segment bottom support shelves releasably engages with one of the segment bottoms of the plurality of segments to support the plurality of segments of the collapsible assembly in the expanded state.

13. The toilet of claim 8, wherein each segment of the plurality of segments comprises at least one lock hole, said lock hole located on the segment to align with the lock holes of the other segments such that all the lock holes align when the collapsible mechanism is in the compressed state; and wherein a lock pin is receivable in the aligned lock holes to secure the collapsible mechanism in the compressed state.

14. The toilet of claim 8, wherein said support mechanism being in the engaged position when the support mechanism is moved such that the retaining peg is positioned towards a center of the collapsible mechanism; said support mechanism being in the disengaged position when the support mechanism is positioned away from the center of the collapsible mechanism.

15. The toilet of claim 14, wherein each support mechanism can be rotated from an upright orientation to a standby orientation when the support mechanism is moved into the disengaged position.

* * * * *